US008015667B2

(12) United States Patent
Bonner

(10) Patent No.: US 8,015,667 B2
(45) Date of Patent: Sep. 13, 2011

(54) CONTROLLED RIGGING

(75) Inventor: Brett Colin Bonner, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 144 days.

(21) Appl. No.: 12/371,775

(22) Filed: Feb. 16, 2009

(65) Prior Publication Data

US 2010/0205864 A1 Aug. 19, 2010

(51) Int. Cl.
*E05C 17/64* (2006.01)

(52) U.S. Cl. ..... 16/338

(58) Field of Classification Search ..... 411/536, 411/544, 931, 237, 222, 383; 403/FOR. 100, 403/109, DIG. 8; 16/235, 238, 240, 244–246; 49/344, 340, 339, 418
See application file for complete search history.

(56) References Cited

U.S. PATENT DOCUMENTS 678,680 A * 7/1901 Nash ..... 411/222
4,009,765 A * 3/1977 Leskovec et al. ..... 187/229
4,735,018 A * 4/1988 Duncan et al. ..... 49/340
4,925,364 A * 5/1990 Das ..... 415/150
4,934,203 A * 6/1990 Bailey et al. ..... 74/89.35
2002/0112318 A1* 8/2002 Shin ..... 16/319
2005/0178224 A1* 8/2005 Czarnek ..... 74/89.23

* cited by examiner

*Primary Examiner* — Victor Batson
*Assistant Examiner* — Matthew Sullivan
(74) *Attorney, Agent, or Firm* — Stephen G. Mican

(57) ABSTRACT

A method of adjusting a hinged linkage that has at least one linear actuator coupled to it, wherein one end of the actuator couples to the linkage and another end fastens to a stationary mounting by way of a rod with a threaded end that mates with a threaded aperture in a ferrule nut that has a threaded section passing through an aperture in the stationary mounting, comprises the steps of: extending the actuator to open the linkage; placing at least one elastic element with a desired force constant over the threaded section of the ferrule nut; threading an adjustment nut onto the threaded section of the ferrule nut with a desired gap between the adjustment nut and the stationary mounting; retracting the actuator to close the linkage; and rotating the adjustment nut and the ferrule nut together to compress the elastic element against the stationary mounting; extending the actuator to open the linkage; and rotating the adjustment nut to compress the elastic element against the stationary mounting.

19 Claims, 13 Drawing Sheets

CONTROLLED RIGGING

FIELD OF THE INVENTION

The invention relates to rigging for actuator-controlled doors or linkages, and more particularly to a method of aligning rigging for actuator-controlled doors or linkages.

BACKGROUND OF THE INVENTION

In some applications that have an actuator-controlled door, such as an inlet door for an inlet duct on aeronautical vehicles, adjustment of the inlet door is by way of a clevis and adjustment nut coupled to a door actuator to fair the door. The current adjustment procedure for such a door comprises sequentially adjusting the clevis and adjustment nut in the door open position and measuring the resulting fair in the closed position, repeating this sequence as necessary to achieve a desired fair of the door.

In the closed position, there are two factors that most affect the desired fair of the door. These two factors are door seal preload, which creates stress in the system, wherein generally lower stress is better; and door seal compression, which maintains a fire barrier, wherein generally more compression is better. These two factors result in opposing design points that create a narrow window of required door adjustment tolerance. The current adjustment procedure does not ensure the combination of required door seal preload and door seal compression due to dimension tolerance of the door components that combine to cause variation between the adjustment of the door in the open position and measurement of the fair in the closed position.

SUMMARY OF THE INVENTION

The invention generally comprises a method of adjusting a hinged linkage that has at least one linear actuator coupled to it, wherein one end of the actuator couples to the linkage and another end fastens to a stationary mounting by way of a rod with a threaded end that mates with a threaded aperture in a ferrule nut that has a threaded section passing through an aperture in the stationary mounting, comprising the steps of: extending the actuator to open the linkage; placing at least one elastic element with a desired force constant over the threaded section of the ferrule nut; threading an adjustment nut onto the threaded section of the ferrule nut with a desired gap between the adjustment nut and the stationary mounting; retracting the actuator to close the linkage; and rotating the adjustment nut and the ferrule nut together to compress the elastic element against the stationary mounting; extending the actuator to open the linkage; and rotating the adjustment nut to compress the elastic element against the stationary mounting.

DETAILED DESCRIPTION OF THE INVENTION

Figure 1:
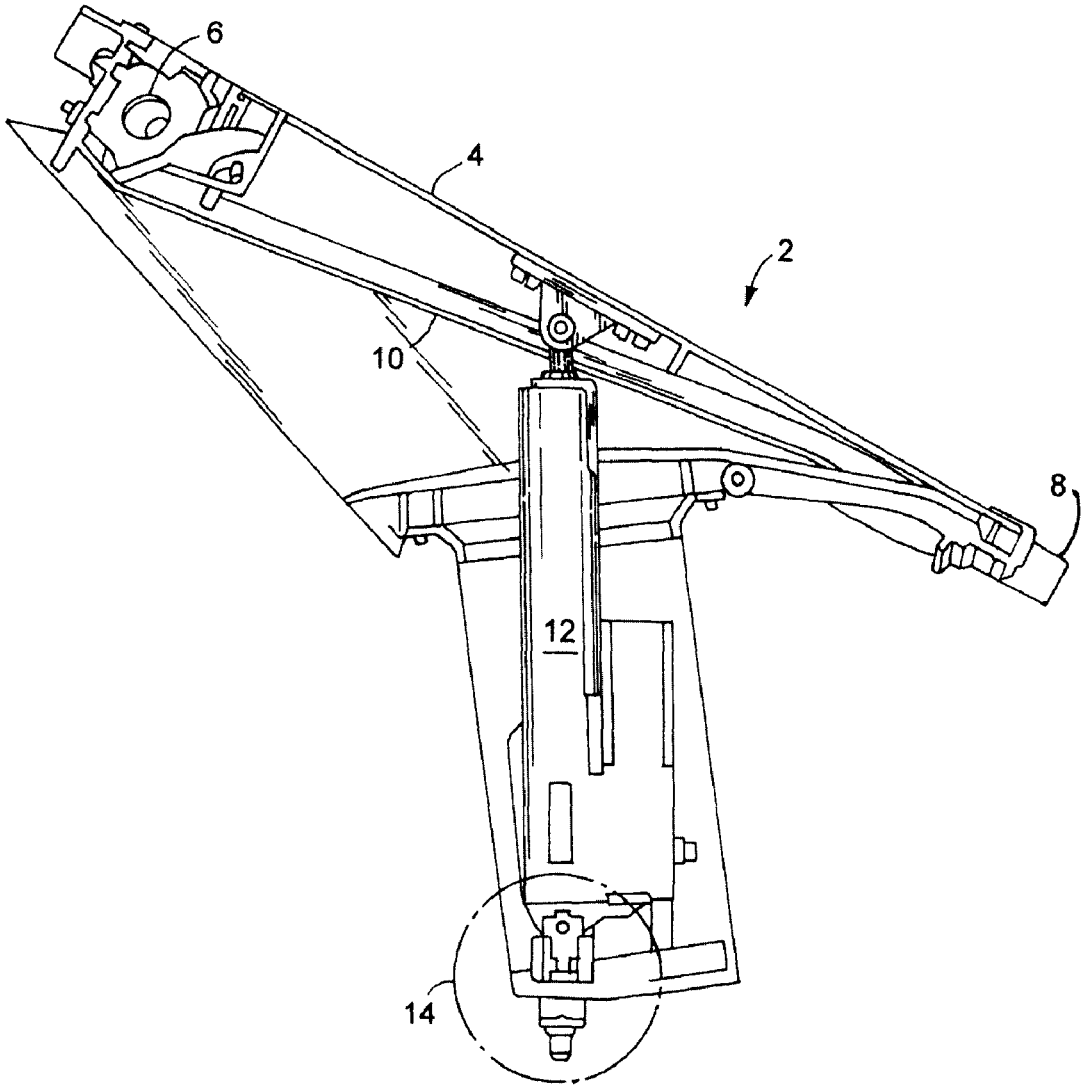
FIG. 1 is a side view of an actuator-operated door or linkage assembly that is suitable for incorporating at least one possible embodiment of the invention.

FIG. 1 is a side view of an actuator-operated door or linkage assembly 2 that is suitable for incorporating at least one possible embodiment of the invention. The actuator-operated door or linkage assembly 2 comprises a door or linkage 4 that swings on at least one door hinge 6 attached to a stationary frame or mounting 8 to seal a vent 10 proximate stationary mounting 8.

Figure 2:
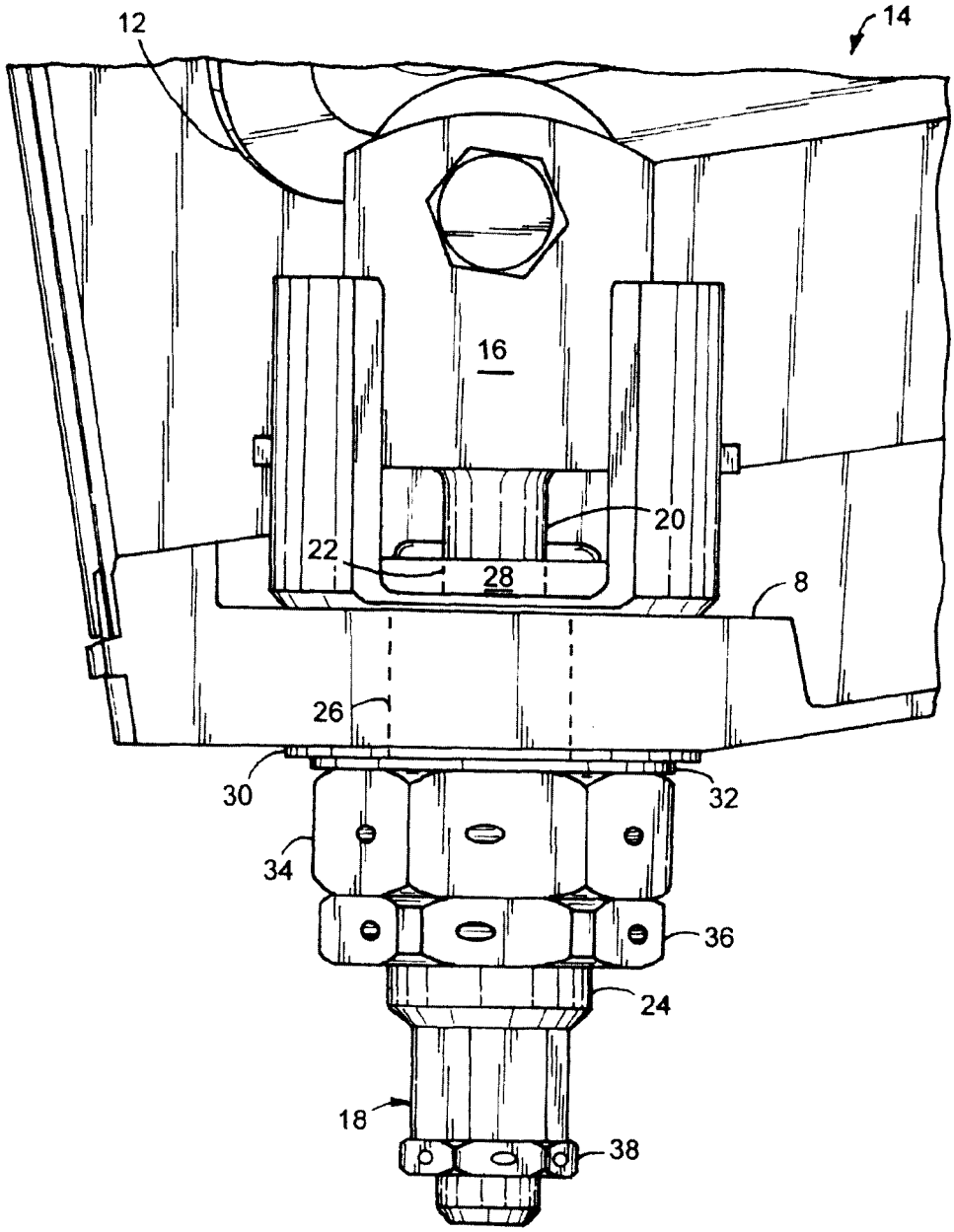
FIGS. 2 through 13 are side views of adjustment components for the actuator-operated door or linkage assembly of FIG. 1 in various stages of a door or linkage adjustment process according to a possible embodiment of the invention.

FIGS. 2 through 15 are side views of adjustment components for the actuator-operated door or linkage assembly 2 of FIG. 1 in various stages of a door or linkage adjustment process according to a possible embodiment of the invention. Referring to FIGS. 1 and 2 together, at least one linear actuator 12 coupled to the linkage 4 couples to the stationary mounting 8 by way of a rod adjustment assembly 14. The rod adjustment assembly 14 comprises a rod 16 that mates with in a ferrule nut 18 by way of a rod threaded end 20 and a ferrule nut threaded aperture 22. A threaded outer section 24 of the ferrule nut 18 passes through an aperture 26 in the stationary mounting 8 to allow a lip 28 on an end of the ferrule nut 18 to seat on the stationary mounting 8 proximate the actuator 12.

At least one elastic element 30 fits over the threaded section ferrule nut threaded section 24. Each elastic element 30 may comprise a spring washer, such as a spring washer of the cupped "Belleville" or wave type, a helical compression spring, or even an elastomeric washer. A combination of different types of the elastic elements 30 is also feasible. Elastic elements 30 of the Belleville type are particularly convenient in that they may stack in a combination of alternate, same or mixed direction to get a decreased or increased resultant force constant. In any case, the force constant of the selected elastic element 30 or combination of elastic elements 30 should result in a force amounting to a desired level of force that corresponds to the desired preload for the linkage 4.

A flat washer 32 may optionally fit over the ferrule nut threaded section 24; followed by a ferrule nut adjustment nut 34 and a ferrule nut jam nut 36, both of which thread onto the ferrule nut threaded section 24 to securely hold the elastic elements 30 in place with a desired level of preload for the linkage 4. A rod jam nut 38 may thread onto the rod threaded end 20 to prevent rotation of the ferrule nut 18 on the rod 16.

Figure 3:
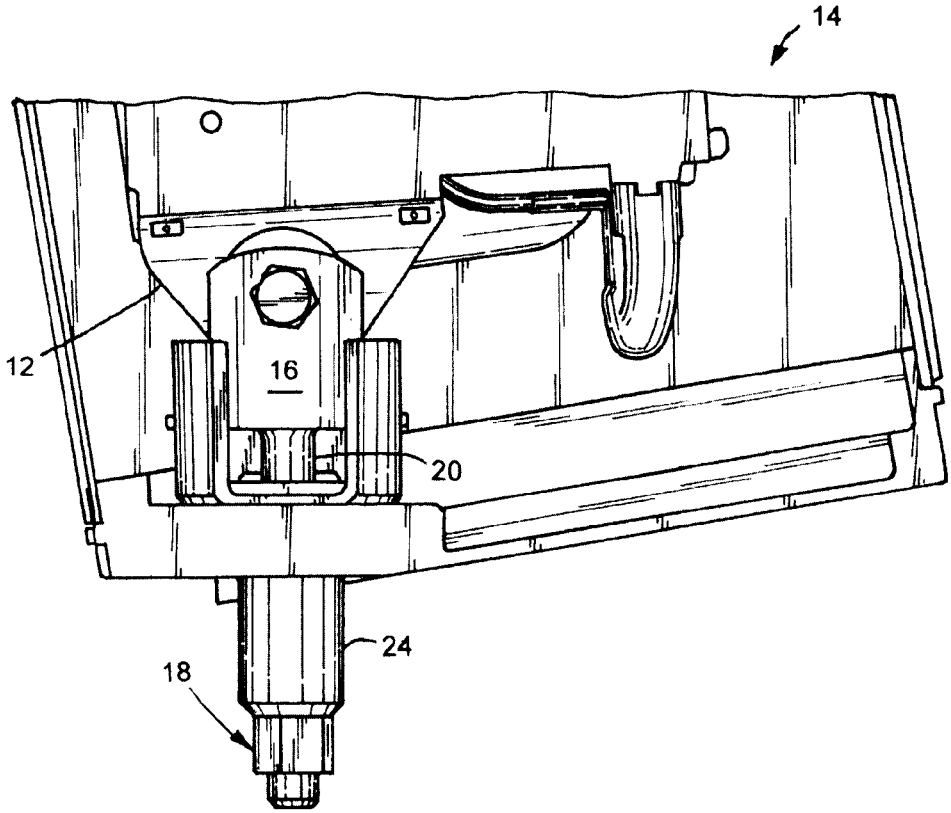
Figure 4:
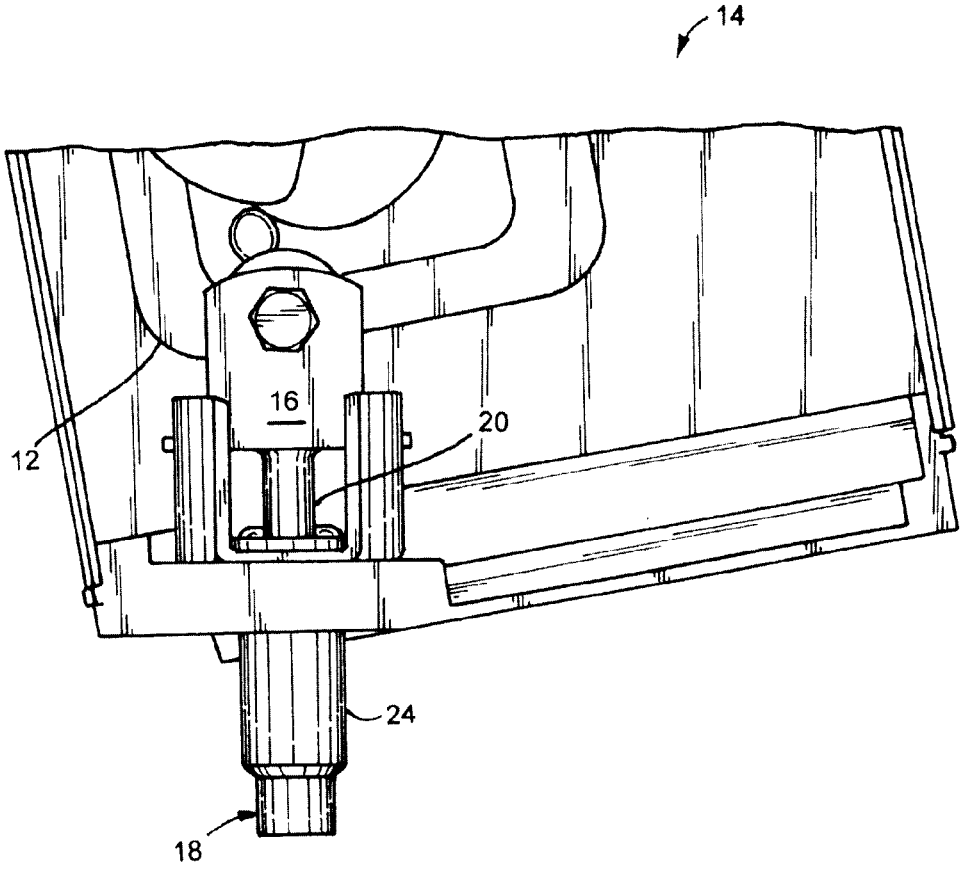
Figure 5:
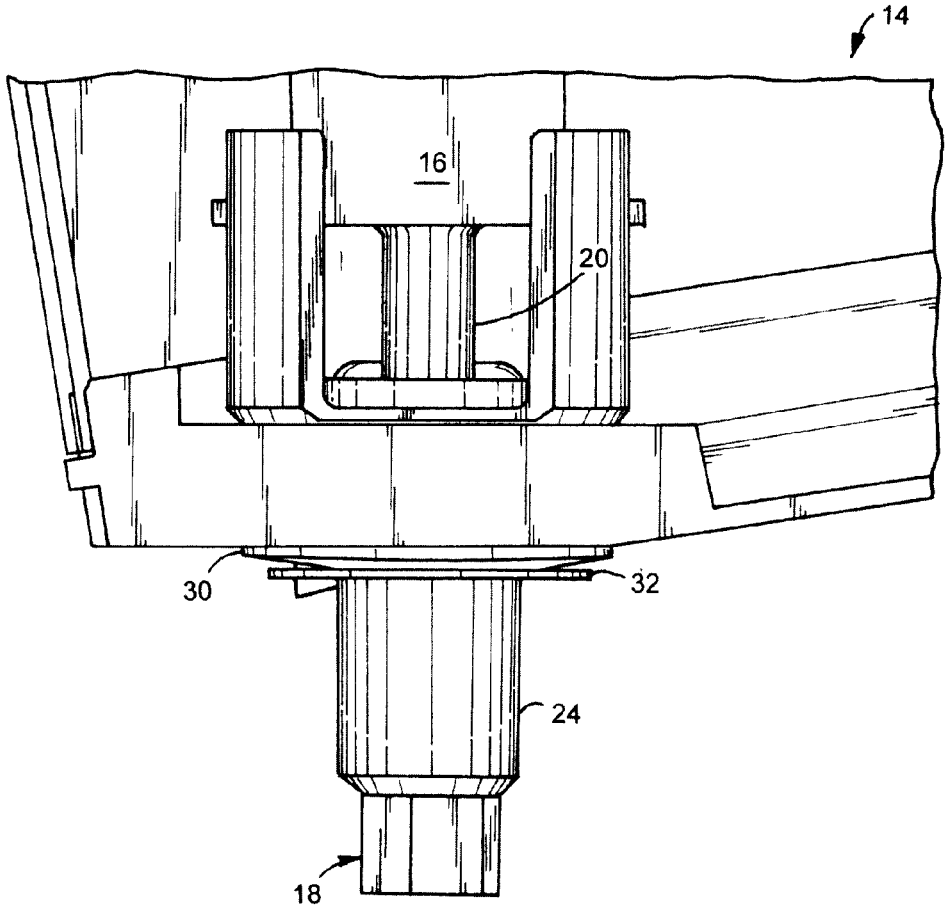

FIGS. 3 and 4 show the first step of the process, which is to turn the ferrule nut 18 on the rod 16 so that the end of the rod threaded section 20 is flush with the ferrule nut 18. FIG. 5 shows the second step of the process, which is to fit each elastic element 30 over the threaded section ferrule nut threaded section 24, followed by the flat washer 32. If there is only a single elastic element 30 of the Belleville type, the large diameter of the elastic element 30 should face the stationary mounting 8.

Figure 6:
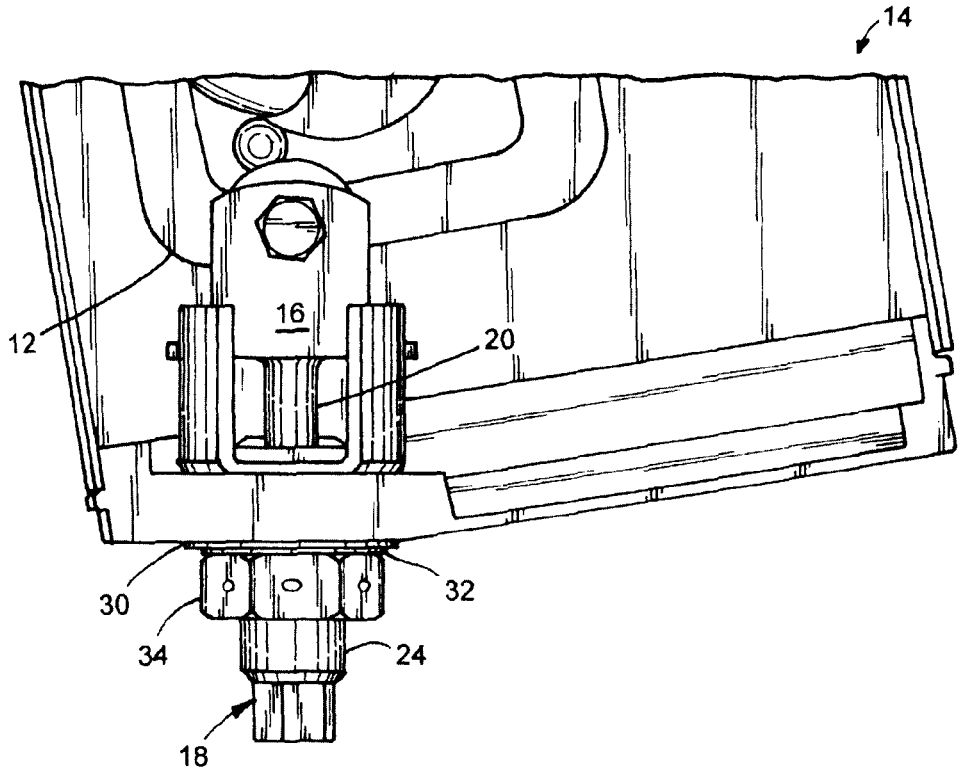

FIG. 6 shows the next step of the process, which is to thread the ferrule nut adjustment nut 34 onto the ferrule nut threaded section 24 and tighten it against the flat washer 32. It is desirable to tighten the adjustment nut 34 within a torque range that overcomes friction and creates adequate preload to insure that the ferrule nut 18 seats properly in the mounting aperture 26, even though it appears to bottom out. The ferrule nut 18 may have a gap between its lip 28 and the stationary mounting 8 and friction between the ferrule nut 18 and the mounting aperture 26 may prevent the light force of "hand tightening" the adjustment nut 34 to pull the ferrule nut 18 completely through the mounting aperture 26.

Figure 7:
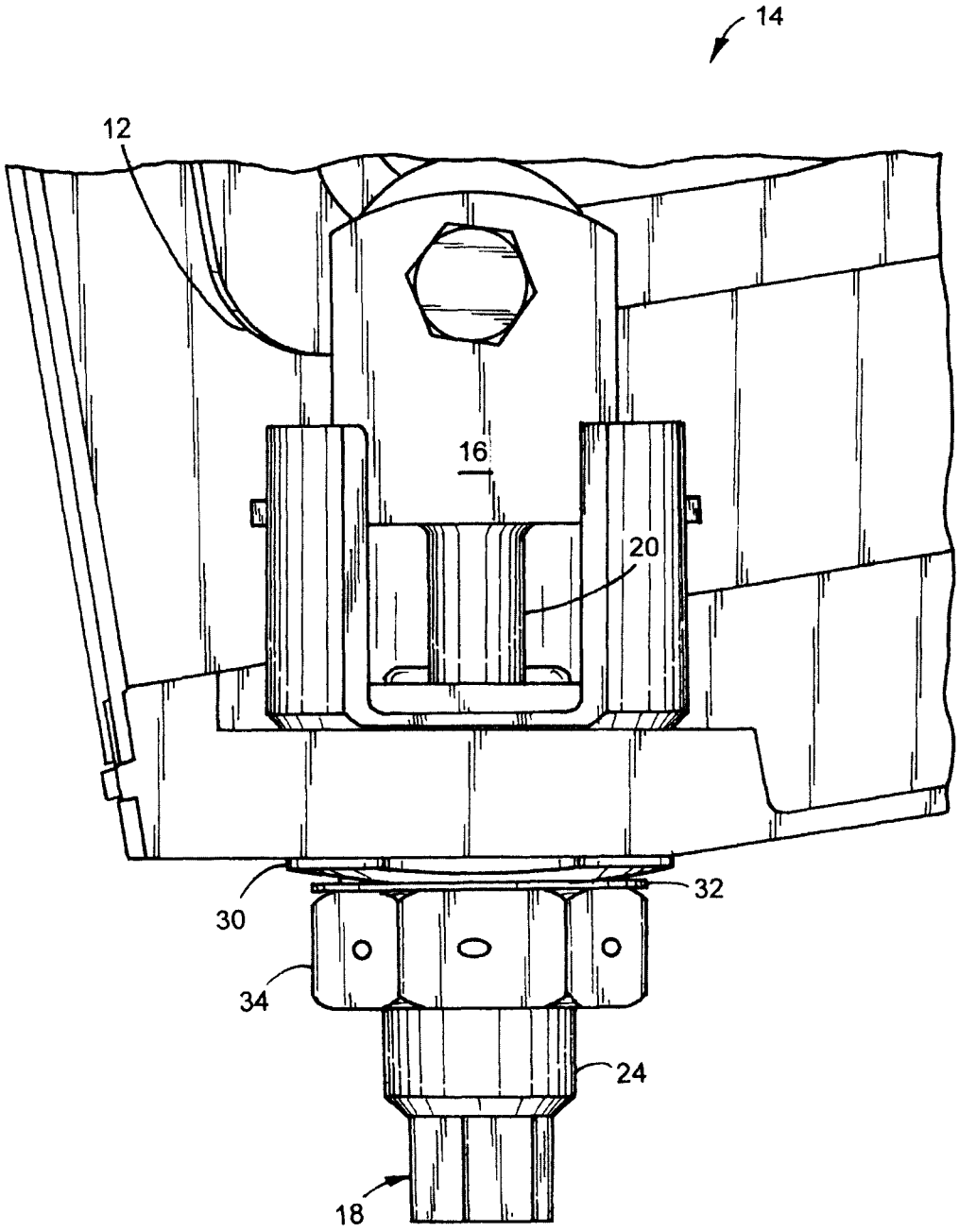
Figure 8:
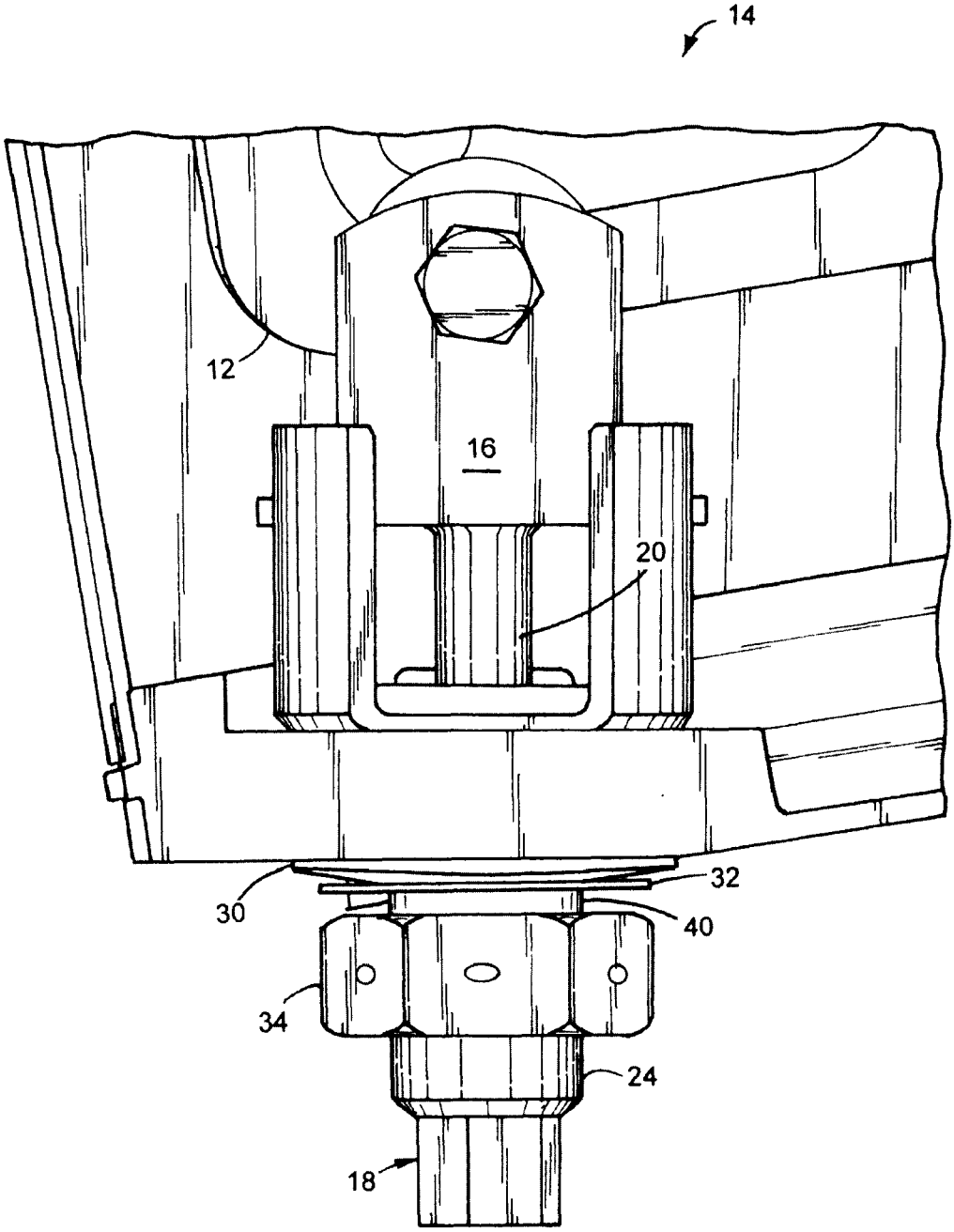

The next step is to loosen the adjustment nut 34 and then "hand tighten" it against the flat washer 32, as shown in FIG. 7. If it is desirable to generate a preload for the linkage 4 that is greater than what the elastic element 30 or elastic element 30 combination provides, or to allow a range of adjustment for the linkage preload, it may be desirable to loosen the adjustment nut 34 sufficiently to allow a gap 40 of a predetermined number of turns of the adjustment nut 34, as shown in FIG. 8. The determination of the predetermined number of turns for the gap 40 would depend upon the force constant of the elastic element 30 or elastic element 30 combination and the number of threads per unit distance for the ferrule nut threaded section 24.

Figure 9:
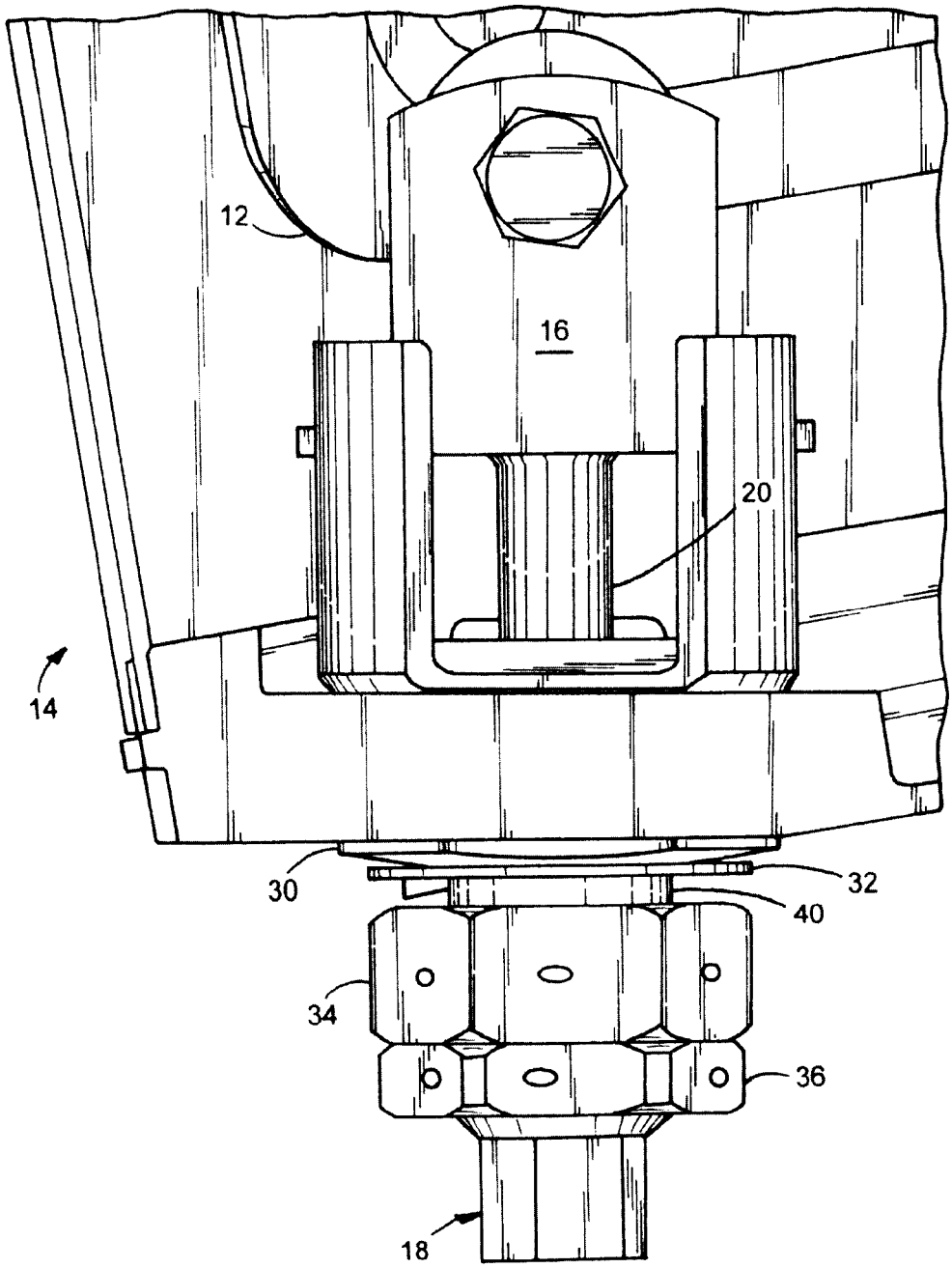
Figure 10:
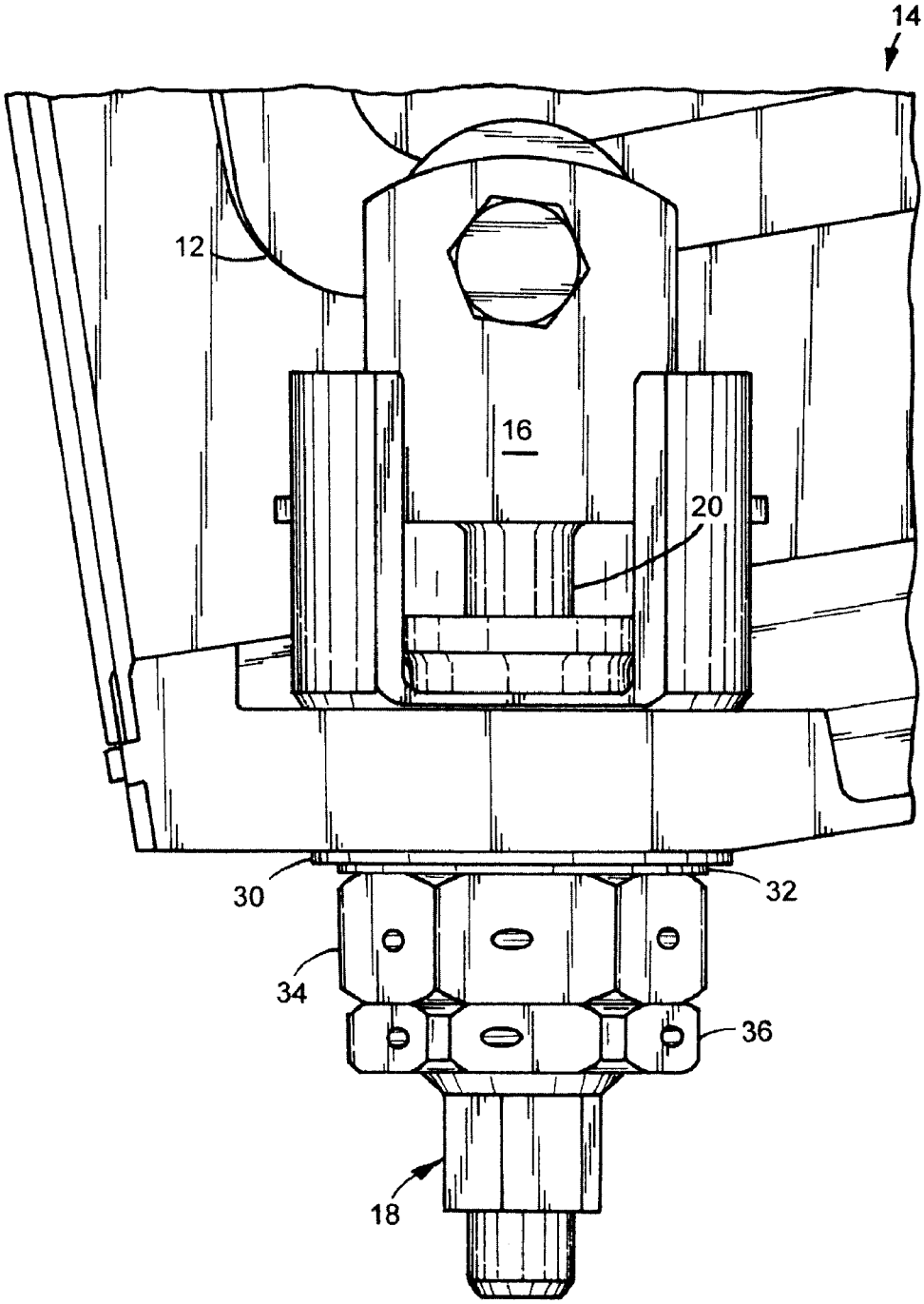

The next step is to thread the ferrule nut jam nut 36 onto the ferrule nut threaded section 24 and tighten it against the adjustment nut 34, as shown in FIG. 9. The next step is to retract the actuator 12 to close the linkage 4. The next step is to tighten the ferrule nut jam nut 36, adjustment nut 34 and ferrule nut 18 combination against the flat washer 32 to fully compress the elastic element 30 or elastic element 30 combination, as shown in FIG. 10.

Figure 11:
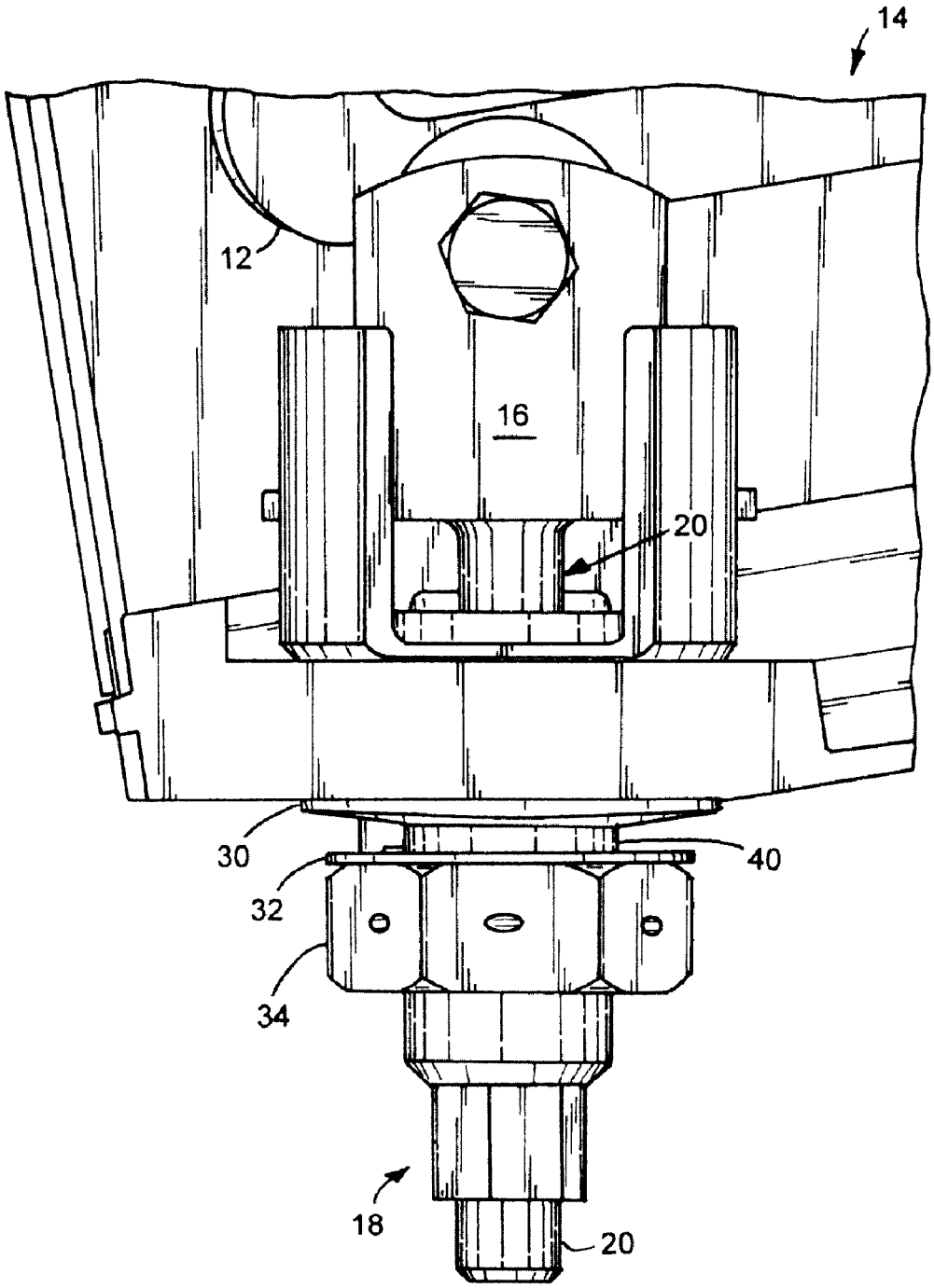
Figure 12:
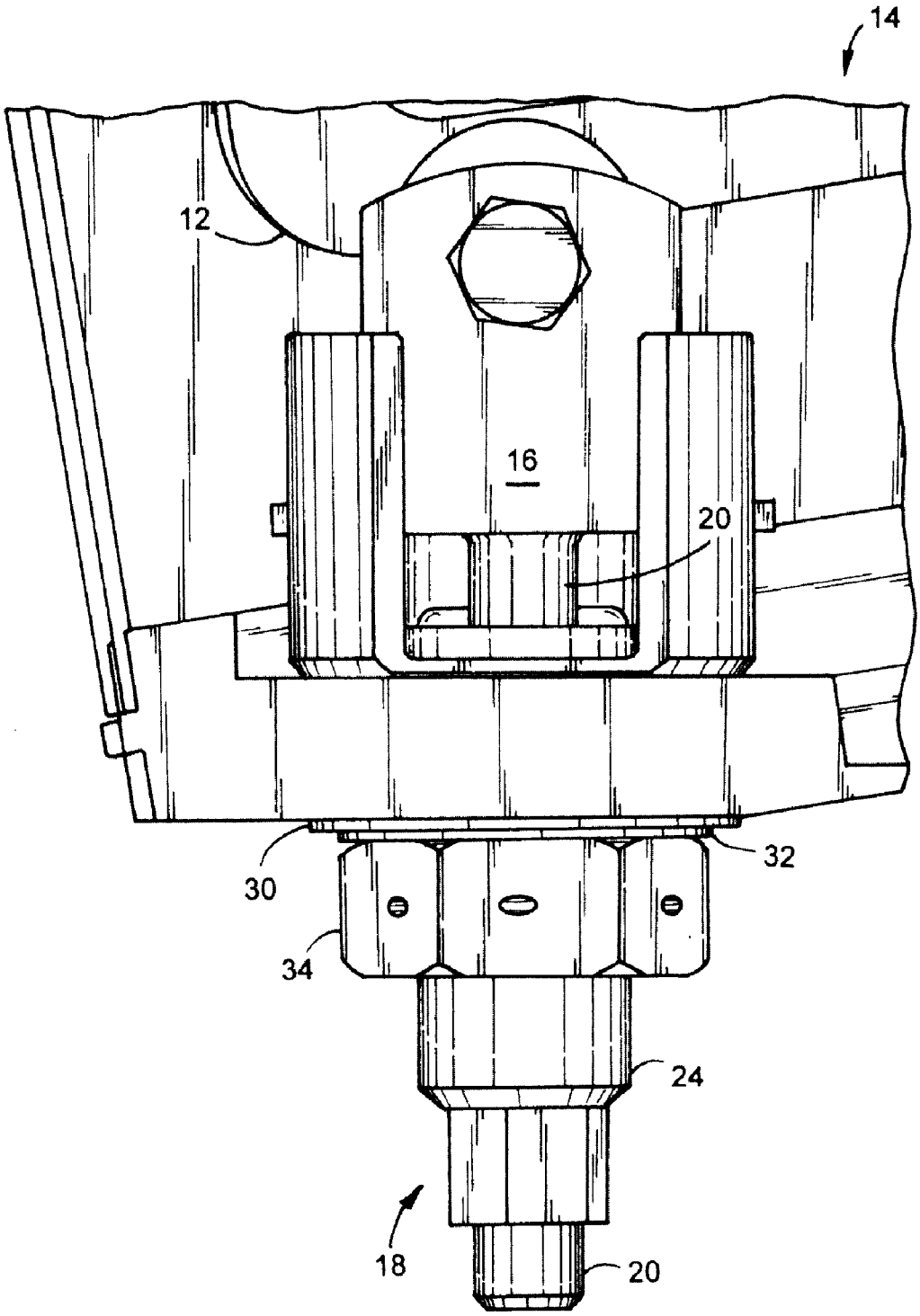

The next step is to loosen and remove the ferrule nut jam nut 36, taking care to not rotate the ferrule nut 18, as shown in FIG. 11. Optionally, a next step may be to rotate the ferrule nut 18 a predetermined number of turns, either clockwise or counter clockwise, to change the total amount of preload. The next step is to tighten the adjustment nut 34 against the flat washer 32 to fully compress the elastic element 30 or elastic element 30 combination, as shown in FIG. 12. It may be desirable to tighten the adjustment nut 34 within a torque range that is capable of ensuring locking features or preload is adequate to maintain integrity of the actuator assembly 2 in service. The next step is to rethread the ferrule nut jam nut 36 onto the threaded section ferrule nut threaded section 24 and tighten it against the adjustment nut 34, followed by threading the rod jam nut 38 onto the rod threaded end 20 and tightening it against the ferrule nut 18, as shown in FIG. 13.

Figure 13:
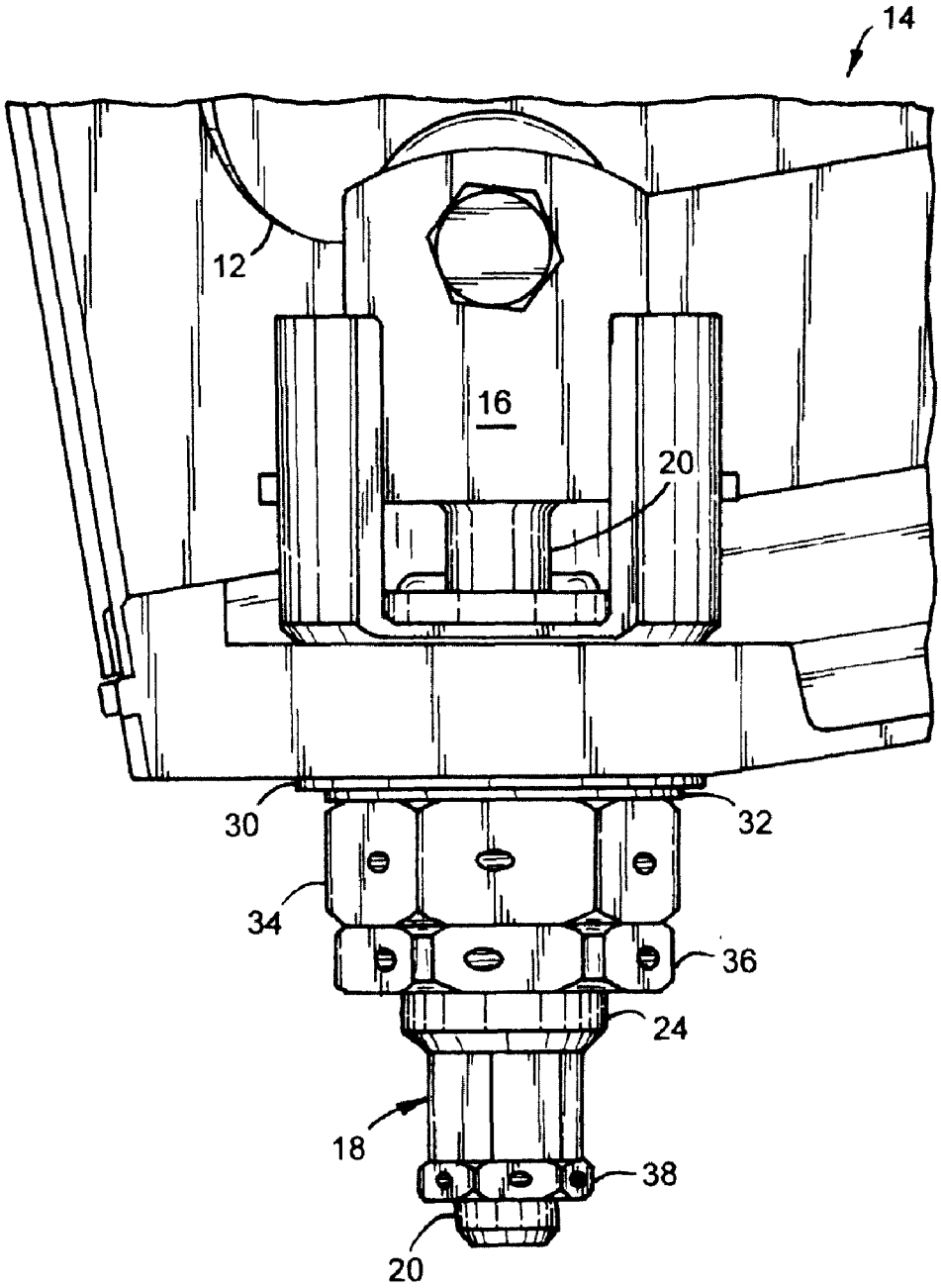

Of course, if the elastic element 30 or elastic element 30 combination provides the desired degree of preload for the linkage 4 and no range of adjustment is necessary, it is possible to proceed directly from threading the ferrule nut adjustment nut 34 onto the ferrule nut threaded section 24 and tighten it against the flat washer 32 as shown in FIG. 6 and then directly threading the ferrule nut jam nut 36 onto the threaded section ferrule nut threaded section 24 and tighten it against the adjustment nut 34, followed by threading the rod jam nut 38 onto the rod threaded end 20 and tightening it against the ferrule nut 18, as shown in FIG. 13. In this case, it may be desirable to tighten the adjustment nut 34 within a torque range that is capable of ensuring locking features or preload is adequate to maintain integrity of the actuator assembly 2 in service before threading the ferrule nut jam nut 36 onto the threaded section ferrule nut threaded section 24.

The described embodiments of the invention are only some illustrative implementations of the invention wherein changes and substitutions of the various parts and arrangement thereof are within the scope of the invention as set forth in the attached claims.

The invention claimed is:

1. An actuator-operated linkage assembly, comprising:

a linkage with at least one hinge attached to a stationary mounting;

a linear linkage actuator with one end coupled to the linkage;

a rod coupled to the other end of the actuator that has a threaded end;

a ferrule nut that mates with the rod threaded end by way of a ferrule nut threaded aperture and that has a threaded outer section passing through an aperture in the stationary mounting;

at least one elastic element fitted over the ferrule nut threaded outer section against the stationary mounting; and an adjustment nut threaded onto the ferrule nut threaded outer section to compress the elastic element against the stationary mounting.

2. The actuator of claim 1, further comprising:

a flat washer that fits over the ferrule nut threaded section between the elastic element and the adjustment nut.

3. The actuator of claim 1, further comprising:

a ferrule nut jam nut that threads onto the ferrule nut threaded section to hold the adjustment nut in place.

4. The actuator of claim 1, further comprising:

a rod jam nut that threads onto the threaded end of the rod to hold the ferrule nut in place.

5. The actuator of claim 1, wherein the elastic element comprises a spring washer.

6. A method of adjusting a hinged linkage that has at least one linear actuator coupled to it, wherein one end of the actuator couples to the linkage and another end fastens to a stationary mounting by way of a rod with a threaded end that mates with a threaded aperture in a ferrule nut that has a threaded section passing through an aperture in the stationary mounting, comprising the steps of:

extending the actuator to open the linkage;

placing at least one elastic element with a desired force constant over the threaded section of the ferrule nut;

threading an adjustment nut onto the threaded section of the ferrule nut with a desired gap between the adjustment nut and the stationary mounting;

retracting the actuator to close the linkage; and rotating the adjustment nut and the ferrule nut together to compress the elastic element against the stationary mounting;

extending the actuator to open the linkage; and rotating the adjustment nut to compress the elastic element against the stationary mounting.

7. The method of claim 6, wherein the step of rotating the adjustment nut and the ferrule nut together and the step of rotating the adjustment nut comprises fully compressing the elastic element.

8. The method of claim 6, wherein the elastic element comprises at least one spring washer.

9. The method of claim 6, further comprising the step of placing a flat washer over the threaded section of the ferrule nut before the step of threading the adjustment nut onto the threaded section of the ferrule nut.

10. The method of claim 6, further comprising the steps of threading a ferrule nut jam nut onto the threaded section of the ferrule nut and tightening the ferrule nut jam nut against the adjustment nut after the step of threading the adjustment nut onto the threaded section of the ferrule nut.

11. The method of claim 10, further comprising the step of loosening the ferrule nut jam nut away from the adjustment nut after the step of rotating the adjustment nut and the ferrule nut together.

12. The method of claim 10, further comprising the step of tightening the ferrule nut jam nut against the adjustment nut after the step of rotating the adjustment nut.

13. The method of claim 6, further comprising the steps of threading a rod jam nut onto the threaded end of the rod after the step of rotating the adjustment nut.

14. A method of adjusting a hinged linkage that has at least one linear actuator coupled to it, wherein one end of the actuator couples to the linkage and another end fastens to a stationary mounting by way of a rod with a threaded end that mates with a threaded aperture in a ferrule nut that has a threaded section passing through an aperture in the stationary mounting, comprising the steps of:

extending the actuator to open the linkage away from the stationary mounting;

placing at least one spring washer with a desired force constant over the threaded section of the ferrule nut;

placing a flat washer over the threaded section of the ferrule nut over the threaded section of the ferrule nut;

threading an adjustment nut onto the threaded section of the ferrule nut with a desired gap between the lock adjustment nut and the stationary mounting;

retracting the actuator to close the linkage toward the stationary mounting;

rotating the adjustment nut and the ferrule nut together to fully compress the spring washer against the stationary mounting;

extending the actuator to open the linkage away from the stationary mounting; and rotating the adjustment nut on the threaded section of the ferrule nut to fully compress the spring washer against the stationary mounting.

15. The method of claim 14, further comprising the steps of threading a ferrule nut jam nut onto the threaded section of the ferrule nut and tightening the ferrule nut jam nut against the adjustment nut after the step of threading the adjustment nut onto the threaded section of the ferrule nut.

16. The method of claim 15, further comprising the step of loosening the ferrule nut jam nut away from the adjustment nut after the step of rotating the adjustment nut and the ferrule nut together.

17. The method of claim 15, further comprising the step of tightening the ferrule nut jam nut against the adjustment nut after the step of rotating the adjustment nut.

18. The method of claim 14, further comprising the steps of threading a rod jam nut onto the threaded end of the rod after the step of rotating the adjustment nut.

19. A method of adjusting a hinged linkage that has at least one linear actuator coupled to it, wherein one end of the actuator couples to the linkage and another end fastens to a stationary mounting by way of a rod with a threaded end that mates with a threaded aperture in a ferrule nut that has a threaded section passing through an aperture in the stationary mounting, comprising the steps of:

extending the actuator to open the linkage;

placing at least one spring washer with a desired force constant over the threaded section of the ferrule nut;

placing a flat washer over the threaded section of the ferrule nut over the threaded section of the ferrule nut;

threading an adjustment nut onto the threaded section of the ferrule nut with a desired gap between the adjustment nut and the stationary mounting;

threading a ferrule nut jam nut onto the threaded section of the ferrule nut;

tightening the ferrule nut jam nut against the adjustment nut;

retracting the actuator to close the linkage toward the stationary mounting;

rotating the adjustment nut, the ferrule nut jam nut and the ferrule nut together on the threaded section of the ferrule nut to fully compress the spring washer against the stationary mounting;

extending the actuator to open the linkage away from the stationary mounting;

loosening the ferrule nut jam nut away from the adjustment nut;

rotating the adjustment nut on the threaded section of the ferrule nut to fully compress the spring washer against the stationary mounting;

tightening the ferrule nut jam nut against the adjustment nut;

threading a rod jam nut onto the threaded end of the rod; and tightening the rod jam nut against the ferrule nut.

* * * * *